US005241726A

United States Patent [19]

Pezzoli et al.

[11] Patent Number: 5,241,726

[45] Date of Patent: Sep. 7, 1993

[54] PROCESS AND DEVICE FOR OPENING AND CLEANING FIBROUS MATERIAL IN AN OPENER

[75] Inventors: Luigi Pezzoli; Emilio Vezzoli, both of Palazzolo Sull'oglio, Italy

[73] Assignee: Fratelli Marzoli & C. S.p.A., Italy

[21] Appl. No.: 705,982

[22] Filed: May 28, 1991

[30] Foreign Application Priority Data

May 29, 1990 [IT] Italy ..... 20464 A/90

[51] Int. Cl.[5] ..... D01G 9/14

[52] U.S. Cl. ..... 19/200; 19/107; 19/203

[58] Field of Search ..... 19/107, 145.7, 200, 19/202, 203, 204, 205, 296, 303, 304, 305

[56] References Cited

U.S. PATENT DOCUMENTS

| | | | |
|---|---|---|---|
| 4,135,275 | 1/1979 | Gunter et al. | 19/107 |
| 4,135,276 | 1/1979 | Handschuch et al. | 19/200 |
| 4,631,781 | 12/1986 | Shofner | 19/200 |
| 4,854,013 | 8/1989 | Pinto et al. | 19/200 |
| 5,031,279 | 7/1991 | Temburg | 19/107 |
| 5,033,165 | 7/1991 | Temburg et al. | 19/200 |

FOREIGN PATENT DOCUMENTS

| | | | |
|---|---|---|---|
| 1078909 | 12/1951 | Fed. Rep. of Germany . | |
| 3006831 | 2/1980 | Fed. Rep. of Germany . | |
| 1575052 | 7/1968 | France . | |
| 2360694 | 4/1978 | France | 19/202 |
| 846596 | 1/1958 | United Kingdom . | |
| 893564 | 5/1959 | United Kingdom . | |

*Primary Examiner*—Clifford D. Crowder
*Assistant Examiner*—Michael A. Neas
*Attorney, Agent, or Firm*—Diller, Ramik & Wight

[57] ABSTRACT

For improving the cleaning effect of a fibrous material in an opener (1) comprising a rotatable opener roller (2) and blades (3,4) and carding plates (5) cooperating with the peripheral surface of the roller (2), there is provided in the material drawing zone at least one separator element (13) for the air current (14) generated by the rotation of the opener roller (2). The separator element (13) penetrates with a certain angle into the air current (14) and so it allows to deviate away from the opener roller (2) a radially outermost part of the air current (14), which owing to a greater centrifugal action includes residual impurities and cotton flocks still incorporating dirt or not yet opened because they have remained clamped between the teeth of the roller clothing, whereas the radially innermost part of the air current (14), which carries cleaned fibrous material that is lighter, is conveyed towards the outlet (16) for the material. The separator element (13) may be adjustable in position.

11 Claims, 2 Drawing Sheets

PROCESS AND DEVICE FOR OPENING AND CLEANING FIBROUS MATERIAL IN AN OPENER

Figure 1:
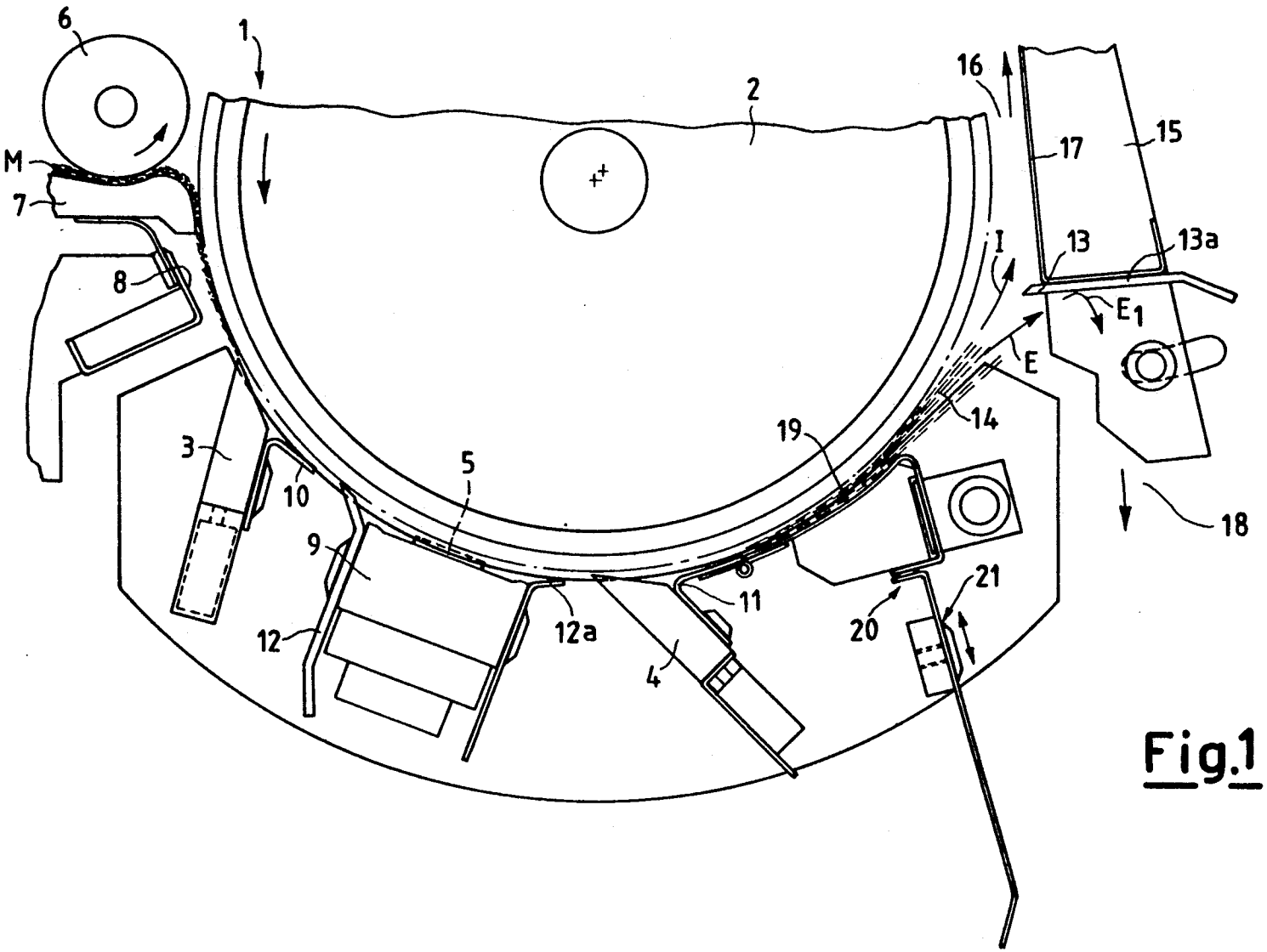

This invention relates to a process and a device for opening and cleaning fibrous material in an opener.

It is known to subject fibrous material, e.g. cotton staple fibres, which must be prepared for spinning, to a fibre-opening and cleaning operation in an opener, essentially consisting of a rotating opener roller, generally provided with a peripheral clothing of metal needles, which draw the material and cooperate with fixed blades and carding elements adapted to open the individual staple fibres, stretch them and make them uniform, and to remove the impurities present, e.g. shell or leaf fragments, sand, etc.

It has already been proposed to arrange the blades and the carding elements so that they are circumferentially and/or radially adjustable with respect to the opener roller, in order to adapt the reciprocal arrangement to the type of material being manufactured and to prevent, as far as possible, the undesired removal of opened fibres or staples and/or an undesired residue of extraneous material or still contaminated staples in the material supplied to the subsequent machines.

However, it is not always possible to achieve the desired qualitative result with only these arrangements, especially if the material displays a certain degree of inhomogeneity with respect to the dimensions of the fibres and the dimensions and nature of the impurities.

The principal object of this invention is to provide a process and a device for opening and cleaning fibrous material in an opener, of the type comprising a rotating opener roller and stationary blades and carding elements associated therewith, by means of which it is possible to improve the cleaning result and consequently the quality of the material emerging from the opener.

Another object of the invention is moreover to provide a process and a device which can be used advantageously and with improved results for different materials without requiring costly adaptation means and operations.

This problem is solved according to the invention by a process for opening and cleaning fibrous material in an opener of the type comprising a rotating opener roller and stationary blades and carding elements associated therewith, in which the fibrous material is brought into contact with the rotating opener roller and impurities are removed essentially by mechanical means during its rotation, characterised in that said process consists in separating the air current generated by the rotation of the opener roller at the outlet side of the drawing zone of the material, the radially outermost current fraction being diverted away from the opener roller and the radially innermost current fraction being directed towards the outlet of the material.

According to a process of this kind, the impurities not removed from the blades or from the carding elements in the active zone thereof and/or the staples still incorporating impurities and/or those remaining between the teeth of the clothing and which are substantially heavier than the cleaned staple fibres and/or which offer smaller resistance to air, are advantageously situated, as a result of the centrifugal force and the smaller resistance to air, in the radially outermost air current fraction, and are thus diverted therewith and can be collected in a collecting chamber and then discharged, whereas the cleaned staple fibres, which are not influenced or are only slightly influenced by the centrifugal force and offer greater resistance to air, remain in contact with the opener roller and in the air current fraction in the vicinity thereof and in this manner are directed therewith towards the outlet. It will be clear that this process provides an additional possibility for cleaning with respect to the prior art, thus giving a final material of improved quality.

The abovementioned process is carried out according to the invention with a device for opening and cleaning fibrous material in an opener of the type comprising a rotating opener roller and stationary blades and carding elements associated therewith and arranged along a drawing zone of the material, characterised in that at the outlet side of this zone is disposed at least one separator element penetrating into the path of the air current generated by the opener roller and having an impact surface oriented so as to divert a radially outermost fraction of the generated air current away from the opener roller.

The separator element can advantageously be adjustably arranged in order to vary the angle of incidence with the air current and/or the degree of penetration of the element into the said path. It is thus possible to adapt the device in a simple manner in order to achieve maximum cleaning, also taking account of the type of material being treated.

Figure 2:
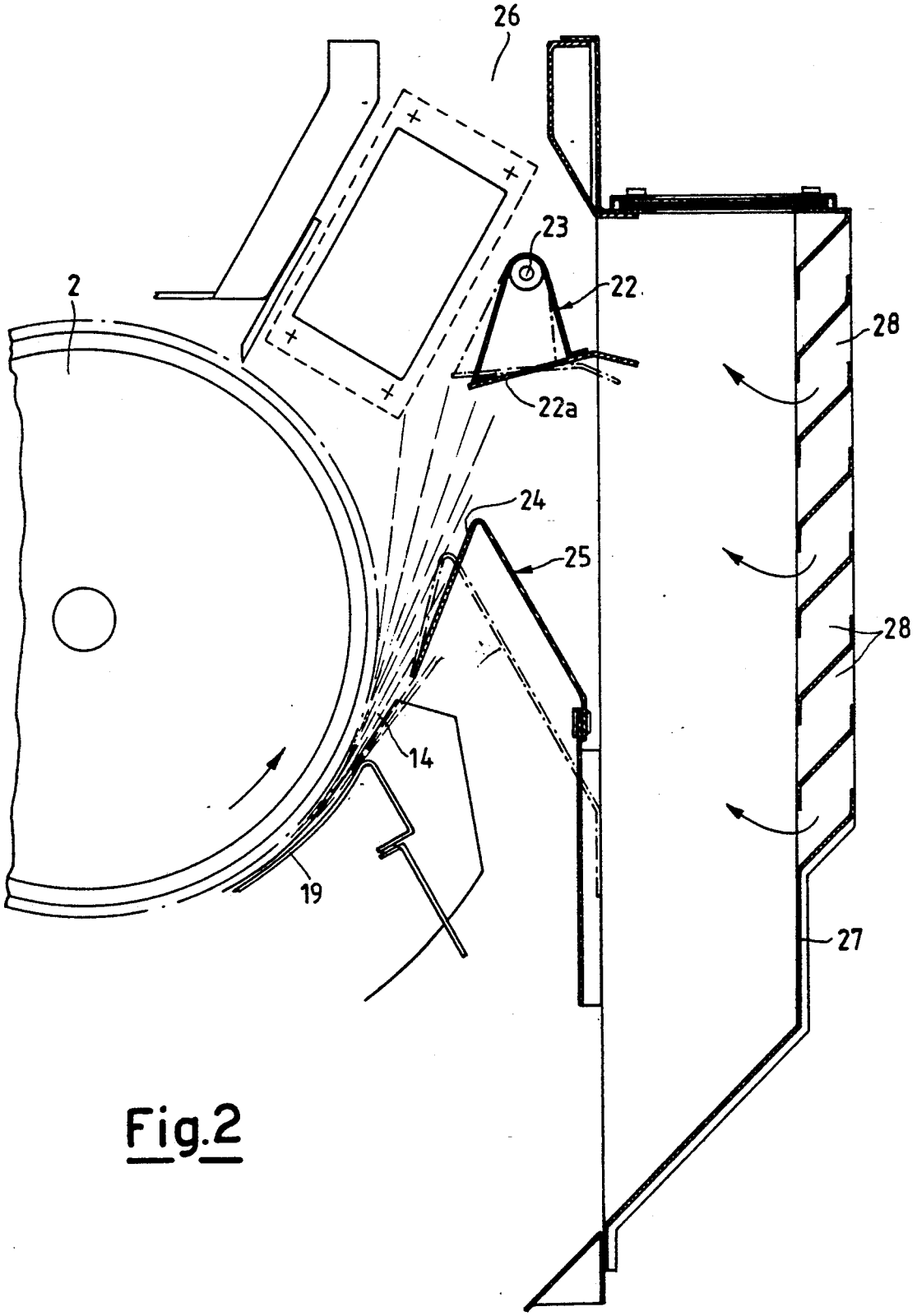

Further details and advantages of the invention will be clear from the following description, with reference to several preferred but not exclusive embodiments of this invention, illustrated by way of example in the accompanying drawings, in which:

FIG. 1 is a diagrammatic side elevation of an opener with a device according to the invention in a first embodiment and FIG. 2 is a partial view of a second embodiment of a device according to the invention.

Referring to the aforementioned drawings, a device according to the invention is applied to an opener 1 of the type comprising a rotating opener roller 2, provided on its periphery with a clothing of metal needles, not shown in detail here as it is known per se, and blades such as those designated 3 and 4, and carding elements such as those designated 5, arranged in a stationary manner and associated with the opener roller 2 in a manner known per se in order to achieve opening and cleaning of the fibrous material, e.g. cotton staple fibres, essentially by mechanical means. The material M is fed from a feed roller 6 arranged on a feed plate 7 in a manner known per se. The reference numeral 8 designates an initial guide surface, it too known from the prior art.

Guide tiles 10 and 11 and 12 and **12*a* respectively are associated with the blades 3 and 4 and with the supporting unit 9 for the carding plates 5. The pairs of blades and tiles, like the carding elements, are preferably arranged so that they are circumferentially and/or radially adjustable with respect to the opener roller 2**, in order to adapt the arrangement to the type of material being manufactured and to achieve the most effective opening and cleaning action. The number of blades, tiles and carding plates associated with the opener roller is not essential for this invention, although it is preferable to provide at least two pairs of blades and tiles and at least one plate of carding elements in order to obtain a sufficient degree of opening and cleaning of the material before it emerges from the drawing zone.

According to one feature of the invention, at the outlet side of this zone is disposed at least one separator element 13 penetrating into the path of the air current 14 produced by the rapid rotation of the opener roller 2, e.g. 13–18 m/sec, in the immediate vicinity of the said roller. The separator element 13 is fixed to a supporting structure 15 and has an impact surface 13*a* oriented so as to divert the radially outermost air current fraction 14 away from the opener roller 2 (arrow E). The arrangement is such, however, that it does not obstruct the radially innermost air current fraction 14 (arrow I), which advances towards the outlet zone 16 of the material, if necessary, diverted by a guide surface 17 arranged downstream of the separator element 13.

The separation of the air current according to the invention is advantageous with respect to the cleaning of the material, as the impurities previously not removed and the staples still incorporating dirt or the more compact staples previously remaining between the teeth of the clothing, which are generally heavier than the fibrous material and so are subjected to a greater centrifugal force and/or offer smaller resistance to air, are then situated in the radially outermost air current fraction 14. These impurities and these staples too are then removed and do not get as far as the outlet 16, as in the course of their movement they hit the impact surface 13*a*, by means of which they are diverted (arrow E1) towards a collecting zone 18, where they are no longer thaken up by the air current and can then be removed in a simple manner. This results in an improved degree of cleaning of the material compared to conventional devices.

The separator element 13 or the supporting structure 15 is or are advantageously adjustably arranged so that it is possible to vary the angle of incidence of the current on the impact surface 13*a* and/or the degree of penetration of the separator element 13 into the air current. It is clear that the relation between the volume of air diverted away from the opener roller 2 and that directed towards the outlet 16 varies as a function of the position and angulation of the element 13. This adjustability offers the advantage that it is possible to adapt the device to the material being manufactured and/or to the degree of contamination of said material, in order to achieve maximum final cleaning.

A curved guide surface 19 for the material can advantageously be provided at the outlet side of the feed zone of the material, having a radius slightly greater than that of the opener roller 2 and arranged on a support 20 so as to define, together with the opener roller 2, a space which gradually increases in the drawing direction of the material. The course of this guide surface 19 is preferably such that the line of extension thereof meets the impact surface 13*a* of the separator element 13. This creates a gradual course for the air current 14 towards the zone of the separator element 13, serving for the gradual discharge of the comparatively heavier materials.

The guide surface 19 can also be adjustably arranged, e.g. as represented at 21, in order to vary the degree of opening of the outlet part of the air current 14 as required and according to the type of material M being manufactured.

The separator element 13 can consist, in its simplest form, of a blade, as shown, arranged at an angle in relation to the general direction of the air current 14, or even of a substantially wedge-shaped element, such as the one designated 22 in the variation of FIG. 2. In this case, too, the separator element is preferably adjustably mounted, e.g. mounting the wedge-shaped element 22 so that it can rotate about a pivot 23 and can be fixed in various angular positions. The two positions illustrated by continuous and broken lines respectively show that the adjustability provides for both angular variation of the impact surface 22*a* and for a different degree of penetration of the element 22 into the air current 14.

As a result of the fact that the separator element 22 is arranged relatively far away form the surface 19, it may be advisable to provide a further guide surface 24 downstream of the curved surface 19, the surface 24 being arranged substantially tangetially to the outlet point of the surface 19 and directed towards the impact surface 22*a*, so as to direct the radially outermost air current fraction 14 proper towards this impact surface 22*a*. This surface 24 can be formed by a baffle or angular element 25, which, arranged so that it is separate from the guide surface 19, can constitute a preliminary separator element, associated with the real separator element 22, in that there is a first discharge of air, with material being removed through the space between the elements 19 and 25, said element 25 thus diverting this material towards the outlet, while the element 22 provides for the final separation.

If the rapid rotation of the opener roller 2 generates an outgoing pressure drop greater than that present in the discharge pipe 26 of the material, an additional intake of air is provided for through the cover 27 of the opener and associated openings 28 in the part of the separator element 22 opposite the opener roller 2. This auxiliary intake of air eases transportation of the fibres from the opener roller 2 to the outlet 26 and, if required, allows for the recovery of opened and cleaned staples having reached the current fraction diverted away by the separator element.

It will be clear from this description that the process and the device for separating the air current according to the invention provide for separation of the extraneous material and an improved degree of cleaning. By virtue of the fact that it is possible to adjust the separator element or the separator elements, it is also possible to adapt the process and device to different materials at a reasonable cost and with little constructional work.

In additional to all of the variations described hereinabove, several other embodiments are of course also possible within the scope of this invention. Thus, e.g. the separator element or elements can take various forms, although its arrangement at the outlet side of the drawing zone of the material and the presence of an impact surface diverting the air and the material therein away from the opener roller 2 are retained. The separator elements can be fixed to movable supports instead of fixed supports. It is also possible to provide more than two separator elements arranged one after another.

We claim:

1. Process for opening and cleaning fibrous material in an opener of the type comprising a rotating opener roller and blades and stationary carding elements associated therewith collectively defining a drawing zone in which the fibrous material is brought into contact with the rotating opener roller and impurities are removed essentially by mechanical means during rotation of said roller characterised in that said process comprises separating air current generated by the rotation of the opener roller at an outlet side of said drawing zone of the material, and diverting a radially outermost current fraction away from the opener roller and directing a radially innermost current fraction towards an outlet for the material.

2. Process according to claim 1, further comprising varying the quantity of air current diverted according to at least one of (a) the material being manufactured and (b) the degree of the contamination of said material.

3. Process according to claim 1 further comprising intaking auxiliary air towards the outlet of the material at the separation zone of the air current.

4. Device for opening and cleaning fibrous material in an opener comprising a rotating opener roller (2), blades (3, 4) and stationary carding elements (5) associated therewith and collectively defining a drawing zone of the material (M), characterised in that at an outlet side of said drawing zone there is disposed at least one separator element (13, 22) projecting into the path of an air current (14) generated by the rotation of the opener roller (2) and having an impact surface oriented so as to divert a radially outermost fraction of the generated air current (14) away from the opener roller (2), and a gap between said opener roller (2) and said at least one separator element (13, 22) through which a radially innermost fraction of the generated air current (14) passes toward an outlet (16) for the material.

5. Device for opening and cleaning fibrous material in an opener comprising a rotating opener roller (2), blades (3, 4) and stationary carding elements (5) associated therewith and collectively defining a drawing zone of the material (M), characterised in that at an outlet side of said drawing zone there is disposed at least one separator element (13, 22) projecting into the path of an air current (14) generated by the rotation of the opener roller (2) and having an impact surface oriented so as to divert a radially outermost fraction of the generated air current (14) away from the opener roller (2), and means for adjustably mounting said at least one separator element (13, 22) in order to vary at least one of (a) the angle of incidence of the air current (14) and (b) the degree of penetration of the element (13, 22) into said path.

6. Device for opening and cleaning fibrous material in an opener comprising a rotating opener roller (2), blades (3, 4) and stationary carding elements (5) associated therewith and collectively defining a drawing zone of the material (M), characterised in that at an outlet side of said drawing zone there is disposed at least one separator element (13, 22) projecting into the path of an air current (14) generated by the rotation of the opener roller (2) and having an impact surface oriented so as to divert a radially outermost fraction of the generated air current (14) away from the opener roller (2), and said at least one separator element (13) including a blade arranged at an angle in relation to the general direction of the air current (14).

7. Device for opening and cleaning fibrous material in an opener comprising a rotating opener roller (2), blades (3, 4) and stationary carding elements (5) associated therewith and collectively defining a drawing zone of the material (M), characterised in that at an outlet side of said drawing zone there is disposed at least one separator element (13, 22) projecting into the path of an air current (14) generated by the rotation of the opener roller (2) and having an impact surface oriented so as to divert a radially outermost fraction of the generated air current (14) away from the opener roller (2), and an auxiliary intake of air at said at least one separator element (13, 22) opposite the opener roller (2).

8. Device for opening and cleaning fibrous material in an opener comprising a rotating opener roller (2), blades (3, 4) and stationary carding elements (5) associated therewith and collectively defining a drawing zone of the material (M), characterised in that at an outlet side of said drawing zone there is disposed at least one separator element (13, 22) projecting into the path of an air current (14) generated by the rotation of the opener roller (2) and having an impact surface oriented so as to divert a radially outermost fraction of the generated air current (14) away from the opener roller (2), and at the outlet side of said drawing zone there is disposed a curved guide surface (19) for the material having a radius slightly greater than that of the opener roller and arranged so as to define therewith a space which gradually increases in the direction of drawing of the material (M), and a line of extension of said curved surface (19) meets the impact surface (13*a* and 22*a*) of said at least one separator element (13, 22).

9. Device according to claim 8, including means for adjustably arranging said guide surface (19).

10. Device according to claim 8, characterised in that a surface (24) arranged substantially tangentially to an outlet point of said guide surface (19) and directed towards said impact surface (22*a*) is associated with and arranged downstream of said guide surface (19).

11. Device according to claim 10, characterised in that said substantially tangential surface (24) is formed of a section of angled sheet.

* * * * *